United States Patent [19]

Bieganowski

[11] 3,940,134

[45] Feb. 24, 1976

[54] HOCKEY STICK HANDLE DEVICE

[76] Inventor: Leo M. Bieganowski, 81 St. Charles Ave., Dorval, Quebec, Canada

[22] Filed: Dec. 5, 1973

[21] Appl. No.: 422,084

[30] Foreign Application Priority Data

Dec. 8, 1972 Canada ..... 158820

[52] U.S. Cl. ..... 273/67 A; 273/165

[51] Int. Cl.[2] ..... A63B 59/14

[58] Field of Search..... 273/67 R, 67 A, 69, 72 R, 273/75, 80 D, 81 R, 81 B, 81 C, 81 D, 81.2–81.4, 162 R, 165, 194 R, 193 R, 183 D

[56] References Cited

UNITED STATES PATENTS

| | | | |
|---|---|---|---|
| 1,498,382 | 6/1924 | Johnston | 273/165 |
| 1,687,736 | 10/1928 | Root | 273/67 A |
| 1,690,312 | 11/1928 | Rosan | 273/166 |
| 2,793,917 | 5/1957 | Ward | 273/81.4 UX |
| 3,095,198 | 6/1963 | Gasche | 273/165 |
| 3,469,839 | 9/1969 | Pietronuto et al. | 273/72 R |
| 3,533,630 | 10/1970 | Monaco | 273/165 |
| 3,534,960 | 10/1970 | Hanks | 273/75 |
| 3,556,544 | 1/1971 | Hauser | 273/80 D UX |
| 3,712,652 | 1/1973 | Uilkema | 273/80 D UX |
| 3,740,085 | 6/1973 | Evans | 273/81.2 UX |

*Primary Examiner*—Richard J. Apley
*Attorney, Agent, or Firm*—Robert E. Mitchell; Alan Swabey

[57] ABSTRACT

An elongated, rigid, torque-increasing sleeve telescopically received on the flexible handle of a hockey stick; the sleeve being freely slidable, at the player's option, along the stick and having a bore with a cross-section which prevents rotation of the sleeve on the hockey stick handle; the sleeve being optionally positionable, by the player, along the hockey stick handle and retained at a position by a friction brake which includes a flexible side wall of the rigid sleeve; one or more friction plates interposed between the inner surface of the sleeve and the outer surface of the hockey stick handle and activated by a plunger exposed at the outer surface of the sleeve and/or the sleeve includes a slotted side wall permitting opposed side walls to be gripped by a hockey player and frictionally engaged with opposite side surfaces of the hockey stick handle.

5 Claims, 9 Drawing Figures

HOCKEY STICK HANDLE DEVICE

BACKGROUND OF THE INVENTION

1. Field of the Invention

This invention relates to a device for use with a hockey stick. The device provides for improved player control of the hockey stick particularly when shooting or passing a hockey puck.

2. Description of the Prior Art

It is difficult for a hockey player, particularly a young player, to always control the accuracy of his shots or passes. This is because the shaft or handle of the hockey stick has a tendency to turn or twist in the hands of the player when striking the puck with the blade of the stick. The young player cannot always provide enough torque, through his grip on the stick, to prevent this turning tendency.

It is also difficult for a very young player to lift or raise the puck off the ice in shooting or passing it. Again this is due to the lack of torque which a very young player can provide and transmit to the blade of the hockey stick.

The torque provided by the players in both above cases is dependent on their strength and the size of the handle of the stick. It is the purpose of the present invention to provide a device which effectively increases the size of the handle of the hockey stick, without reducing its flexibility, thereby increasing the torque which a player can provide. The increased torque permits younger players to more accurately control their shots and passes, and also permits all players to shoot harder.

SUMMARY OF THE INVENTION

The device comprises a relatively short, substantially rigid sleeve adapted to be non-rotatably mounted on the handle of a hockey stick to provide an enlarged hand grip on the handle. In use, the player grips the sleeve, rather than an intermediate position on the handle of the stick, with one hand. In gripping the sleeve on the handle, rather than the handle itself, the moment arm for manipulating the blade of the stick is effectively increased and thus, so is the applied torque.

During play, it is normal for the player's one hand to normally move along the handle. To accommodate this movement, the sleeve is sized to be normally, freely moved along the length of the handle. It is preferred, however, to have the sleeve fixed in position relative to the handle when shooting or passing and thus the sleeve is provided with means by which the sleeve can be made to selectively grip the handle with a force sufficient to prevent its movement relative to the handle.

BRIEF DESCRIPTION OF THE DRAWINGS

The invention will now be described in detail having reference to the accompanying drawings, in which.

DESCRIPTION OF THE PREFERRED EMBODIMENTS

Figure 2:
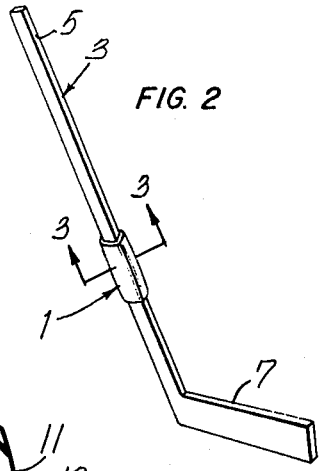
FIG. 2 illustrates the sleeve member of FIG. 1 mounted on a hockey stick.
Figure 3:
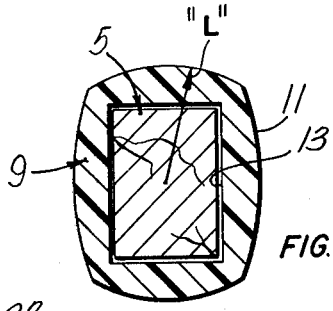
FIG. 3 is a cross-sectional view of the sleeve on the hockey stick taken along line 3—3 in FIG. 2.

The sleeve member 1 of the present invention is employed with a hockey stick 3. As shown in FIG. 2, the sleeve 1 is adapted to be placed on the shaft or handle 5 of the hockey stick above the blade 7. The sleeve 1 has relatively thick, rigid walls 9 to provide an enlarged hand grip region on the handle of the stick. The thicker the walls 9, the higher torque provided since the moment arm "L", from the player's hand on the outer surface 11 of the walls to the longitudinal center of the handle 5, obviously increases. The thickness of the walls 9, or the overall outer size of the sleeve 1, is limited only in having to provide a sleeve sized to be comfortably gripped by the player's hand. The outer surface 11 of the walls 9 are preferably slightly rounded, both laterally, and longitudinally, to provide a more comfortable grip on the sleeve. The inner surface 13 of the walls are planar and preferably define an inner, rectangular, cross-sectional area of the sleeve which is just slightly larger in size than the cross-sectional area of the shaft 5. This permits the sleeve to normally, freely slide along the handle while at the same time preventing rotation of the sleeve relative to the handle. The sleeve has a length sufficient for it to provide a comfortable hand grip. The length can range between 4 and 7 inches. The length should not be much greater than 7 inches to avoid reducing the flexibility of the hockey stick handle. The sleeve can be made out of wood, thermoplastic or metallic material.

Figure 4:
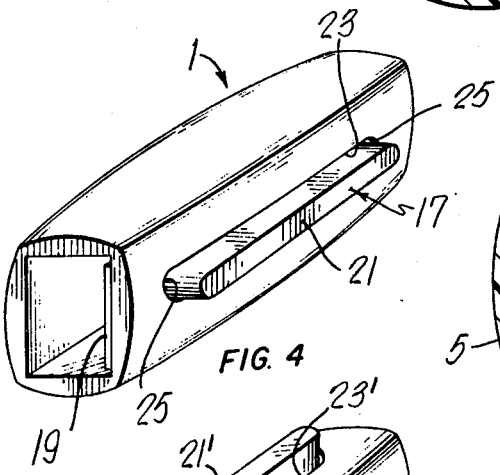
FIG. 4 illustrates another embodiment of the sleeve member according to the present invention.
Figure 5:
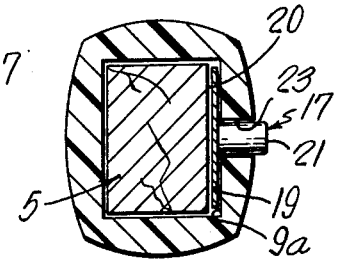
FIG. 5 is a cross-sectional view showing the sleeve of FIG. 4 mounted on a hockey stick.
Figure 6:
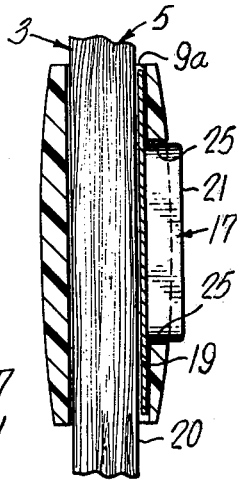
FIG. 6 is a longitudinal sectional view showing the sleeve member of FIG. 4 mounted on a hockey stick.

Since it is preferred to have the sleeve fixed relative to the handle, when shooting or passing, and movable relative to the handle at other times, suitable means can be provided by which the sleeve can be made to selectively grip the handle with a force sufficient to prevent its movement relative to the handle. As shown in FIGS. 4 to 6, the sleeve 1, of FIG. 1, can be modified to incorporate selective gripping means 17. These means 17 can comprise a thin, flat pressure plate 19 of metal or other suitable material mounted inside the sleeve, adjacent one wall 9*a*, to lie parallel to one side 20 of the handle. The interior cross-sectional area of sleeve 1 is increased slightly to be able to accommodate both the plate 19 and handle 5. A plunger 21 extends from the plate out through a slot 23 in the one wall 9*a*. When it is desired to "lock" the sleeve against movement relative to the hockey stick, the projecting plunger 21 is pushed in by the hockey player, usually by merely tightening his grip on the sleeve. This forces the plate 19 against the one side 20 of the handle to frictionally hold the plate 19 against movement relative to the shaft and thus to hold the sleeve, through its contact with the plunger 21 by the end walls 25 of its slot 23. Releasing the pressure on the plunger 21 will again allow the sleeve, including the plate 19, to move on the handle.

Figure 7:
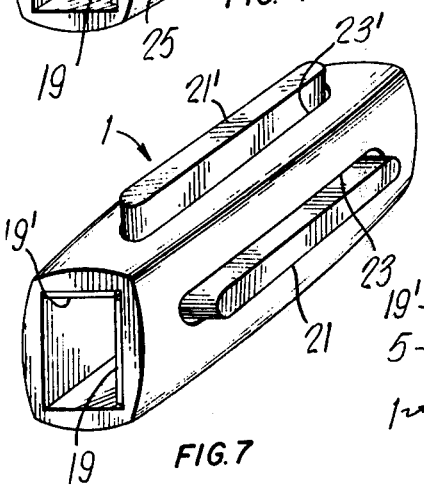
FIG. 7 illustrates another embodiment of the sleeve member according to the present invention.
Figure 8:
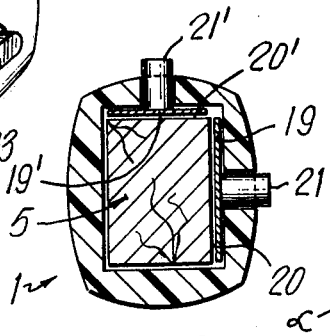
FIG. 8 is a cross-sectional view showing the sleeve of FIG. 7 mounted on a hockey stick.

To provide a more positive lock of the sleeve on the handle when desired, an addiitonal plate 19', bearing against another wall 20' of the handle, may be provided as shown in FIGS. 7 and 8. A plunger 21' extends outwardly through a slot 23' in the wall of the sleeve from plate 19'. The player can thus actuate the two plungers 21, 21' simultaneously if desired providing much more effective gripping of the handle by the two plates 19, 19', and thus a more positive lock of the sleeve.

Figure 9:
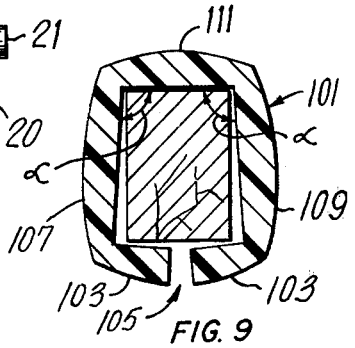
FIG. 9 is a cross-sectional view showing a further embodiment of the sleeve member of the present invention.

Other types of selective gripping means can be employed to hold the sleeve against movement relative to the handle. FIG. 9 illustrates a sleeve 101 which is of the "open" type as compared to "closed" sleeve 1. Sleeve 101 is open in that it does not completely enclose or encircle the handle 5 of the hockey stick. Rather one wall 103 of the sleeve has a slot 105 extending its full length. Preferably, the sleeve 101 is formed so that the opposing full walls 107, 109 flare away from each other to a slight degree in extending from the other full wall 111. Thus the angle between wall 107 and wall 111, and wall 109 and wall 111, is slightly greater than 90°. In operation, sleeve 101 will move readily along the handle, particularly since little contact is made with the handle by flaring walls 107, 109. To lock the sleeve, however, it is only necessary to squeeze walls 107, 109 toward each other to lie flat against opposed sides 113, 115 of the shaft and thus frictionally hold the sleeve in place. The sleeve 101 can be advantageously moulded from thermoplastic material to provide inherent resiliency tending to return walls 107, 109 to their original flared position when a lock on the handle is no longer required, and the squeezing grip on the walls is released or relaxed.

Figure 1:
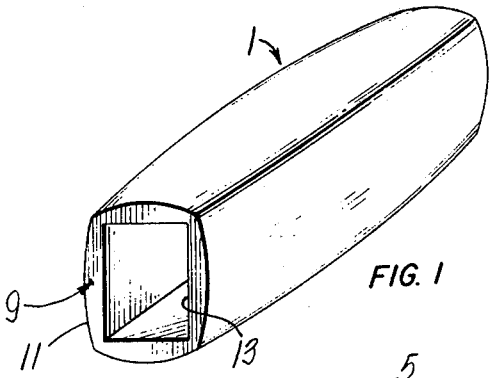
FIG. 1 illustrates a sleeve according to the present invention.

It is also contemplated that a portion of wall 9 of sleeve 1 shown in FIG. 1 could be made to have more flexible characteristics from the remainder of the wall, thereby allowing this more flexible wall portion to be pushed in against the handle when it was desired to lock the sleeve.

I claim:

1. In a hockey stick including an elongated, generally-longitudinally-flexible handle having a substantially rectangular cross-section and a laterally-extending terminal blade extending vertically into the general plane of the rectangularly cross-sectioned handle, the improvement comprising, in combination, manually-operable, torque-increasing means optionally adjustable at a player's option during play when effecting a puck-propelling movement in a combined rotary and sweeping manipulation of the hockey stick, said torque-increasing means comprising a relatively short rigid sleeve member including an inner surface portion circumposed about the handle and an outer surface portion to be gripped by the player and being of a length short enough not to interfere with the general-longitudinal-flexibility of the hockey stick handle, said sleeve member being constructed and arranged to be optionally freely slidable along and non-rotatably mounted on said hockey stick handle and optionally-positionable therealong prior to a puck-propelling manipulation and increasing the hockey stick cross-section at the position at which said sleeve member is disposed, said sleeve member having means for manually-displacing at least one inner surface portion of said sleeve member for frictionally engaging and locking the sleeve member relative to a confronting portion of said hockey stick handle so the sleeve member does not freely slide along the hockey stick handle whereby prior to effecting a puck-propelling manipulation the player can readily adjustably position the sleeve member and is afforded increased torque-generating means about the longitudinal axis of the hockey stick handle so that the increased torque can be correspondingly directed to the hockey stick blade.

2. The combination as claimed in claim 1, in which said means for manually-displacing at least one inner surface portion of the sleeve member comprises at least one friction plate interposed between the outer surface of the stick handle and an inner surface of the sleeve member, and plunger means accessibly-disposed at the outer surface of the sleeve member and operatively connected to the friction plate and displaceably projecting through the sleeve member whereby gripping action of a player's hand on the sleeve member can cause the friction plate to lockingly engage the handle at the position optionally selected by the player.

3. The combination as claimed in claim 2, in which said means for manually-displacing at least one inner surface portion of the sleeve member comprises a second friction plate interposed between the outer surface of the stick handle and an inner surface of the sleeve member, and second plunger means operatively connected to the second friction plate and projecting through the outer surface of the sleeve member whereby both friction plates can be lockingly engaged to the stick handle when the plunger means are gripped by a player.

4. The combination as claimed in claim 1, in which said means for manually-displacing at least one inner surface portion of the sleeve member comprises an integral flexible wall portion in the sleeve member which is more flexible than adjacent portions of said sleeve member.

5. The combination as claimed in claim 1, in which said means for manually-displacing at least one inner surface of the sleeve member comprises a full wall on said sleeve member engageable at its inner surface with one side of said hockey stick handle, opposed full walls on said sleeve member diverging from said first-mentioned full wall in flared relationship at opposite sides of the rectangularly cross-sectioned handle, and a wall projecting inwardly from the respective opposed, diverging full walls and interrupted by a longitudinally extending slot in the sleeve member whereby gripping action of a player on the sleeve member can cause the diverging walls to grippingly engage opposite sides of the hockey stick handle.

* * * * *